US006089030A

United States Patent [19]

Darden

[11] Patent Number: 6,089,030

[45] Date of Patent: Jul. 18, 2000

[54] ICE RAKE STORAGE AND DELIVERY SYSTEM AND METHOD OF USING THE SAME

[76] Inventor: Larry E. Darden, 6237 Woodlake Dr., Buford, Ga. 30515

[21] Appl. No.: 09/112,901

[22] Filed: Jul. 9, 1998

[51] Int. Cl.[7] ..... F25C 5/18

[52] U.S. Cl. ..... 62/66; 62/344; 222/146.6; 414/301

[58] Field of Search ..... 62/66, 344; 222/146.6, 222/410; 414/287, 301

[56] References Cited

U.S. PATENT DOCUMENTS

| | | | |
|---|---|---|---|
| 2,791,887 | 5/1957 | Hennig | 62/344 |
| 3,842,993 | 10/1974 | Hagen | 62/344 |
| 4,139,126 | 2/1979 | Krasner et al. | 222/410 |
| 4,254,896 | 3/1981 | Stanford et al. | 222/410 |
| 4,541,252 | 9/1985 | Reimer | 62/344 |
| 4,635,408 | 1/1987 | Burke et al. | 222/410 |
| 5,299,716 | 4/1994 | Hawkins et al. | 222/146.6 |
| 5,910,164 | 6/1999 | Snelling et al. | 62/344 |

OTHER PUBLICATIONS

"Ice Rake Storage and Delivery Systems," brochure by Turbo Refrigerating Company, total of four pages, Dec., 1990.

*Primary Examiner*—William E. Tapolcai
*Attorney, Agent, or Firm*—Jones & Askew, LLP

[57] ABSTRACT

An ice storage and delivery system for radially displacing fragmentary ice stored within an ice storage bin. The ice storage and delivery system has a rotating ice rake of elongated members which radially displaces a portion of the fragmentary ice stored in the storage bin as each elongated member passes through the pile of fragmentary ice. The ice rake pivots in the storage bin between first and second positions such that the rotating elongated members may radially displace the fragmentary ice into a screw conveyor in the floor of the storage bin while in the first position and level-out the fragmentary ice stored in the storage bin while in the second position. In order to displace the fragmentary ice into the screw conveyor and remove the fragmentary ice from the storage bin while in the first position, the displacement assembly translates in the storage bin along the length of the storage bin.

27 Claims, 7 Drawing Sheets

ICE RAKE STORAGE AND DELIVERY SYSTEM AND METHOD OF USING THE SAME

FIELD OF THE INVENTION

The present invention relates to storage bins for fragmentary ice. This invention more particularly pertains to an ice rake storage and delivery system for evacuating ice from a storage bin.

BACKGROUND OF THE INVENTION

In the commercial ice making industry, fragmentary ice is formed from sheets of ice. These sheets of ice are formed with industrial and commercial ice making equipment such as freon and ammonia ice makers known to those skilled in the art. Once the sheets of ice are formed, they are broken into fragments and deposited through the top of an ice storage bin. Ice storage bins are used extensively during the manufacture and delivery of fragmentary ice. A variety of storage bins are available which refrigerate ice for any period of time and deliver predetermined amounts of ice to a loading station where the ice is packaged for delivery. These known storage bins utilize an ice rake which discharges ice out of the bin through an opening in the end of the bin and onto a conveyor. The bottoms of these known storage bins are filled first and any new ice is deposited directly on top of any previously stored ice.

Consequently, these known storage bins utilize a first in/last out approach to ice storage and delivery. Known ice rakes first rake ice off the top of the fragmentary ice pile. The ice which is first to enter the storage bin and which is kept at the bottom of the storage bin can only be removed by the ice rake once the ice stored immediately above is evacuated from the storage bin. Thus, the ice at the bottom of the storage bin is stored in the storage bin substantially longer than any ice which has entered the storage bin more recently.

Most commercially available ice rakes utilize a chain and sprocket assembly which drags multiple channel members over the surface of the ice pile. The channel members have teeth and are suspended by the chain and sprocket assembly over the pile of ice. Gravity forces the teeth of each channel member into the pile of ice as the channel members advance in the storage bin. The teeth distribute the fragmentary ice in a level and uniform manner over the length of the bin. This leaves a large foot print in the pile of fragmentary ice. At one end of the storage bin, the ice, which has been collected with each pass of a channel member over the surface of the ice pile, is discharged into an opening in the floor of the storage bin where a screw conveyor removes the fragmented ice. The fragmentary ice is then sized and packaged for sale.

These known ice storage and delivery systems are subject to mechanical difficulties. These ice rakes tend to become buried in the ice pile when the rate of ice entering the storage bin exceeds that rate at which the ice rake is discharging ice from the storage bin. Moreover, the bottom ice (blue ice), which has been left for some time in the storage bin, will compact and solidify. This puts a greater demand on the ice rake to remove the ice from the storage bin before the ice cures into blue ice. Also, the teeth tend to become broken because of the weight of the ice rake as well as the blue ice. Earlier solutions to these problems inherent in the design of these known ice rakes involved building a more rugged ice rake.

Another problem associated with these known storage and delivery systems is rust. Ice and water can rust equipment. To minimize maintenance, the vital components of these known ice storage and delivery systems are typically electro-coated or hot-dip galvanized to minimize rust and corrosion. These vital components may also be available in stainless steel. However, the expense involved in protecting these components from rust and corrosion precludes stainless steel from becoming a viable option with these known ice rakes.

In response to the realized inadequacies of these known ice storage and delivery systems, it became clear there is a need for an ice rake which is corrosion and rust resistant, and less likely to allow blue ice to form. This new ice storage and delivery system must operate with less wear and less chance of breaking down. What is needed is an ice storage and delivery system which has an ice rake consisting of fewer parts and removes the ice stored at the bottom of the storage bin sooner.

BRIEF SUMMARY OF THE INVENTION

The present invention alleviates or solves the above-described problems in the prior art by providing a new self-evacuating ice storage and delivery system. The present ice storage and delivery system satisfies the need for a more corrosion and rust resistant system which is capable of removing ice before blue ice forms.

In accordance with the invention, this object is accomplished by suspending an ice rake having a plurality of elongated members in a storage bin. The storage bin is an enclosure configured for receiving the fragmentary ice. The elongated members are configured for radially displacing ice as the members turn about an axis. The elongated members are spaced equidistant apart and extend radially from the axis. Each elongated member has teeth along its length.

The ice rake pivots in the storage bin so that the elongated members turn in horizontal and vertical planes. The elongated members turn about a horizontal axis when in the vertical plane and turn about a vertical axis when in the horizontal plane. The elongated members level-out the pile of fragmentary ice when turning about the vertical axis in the horizontal plane. The elongated members move the fragmentary ice to a screw conveyor in a trough in the floor of the storage bin, to remove the ice from the storage bin when turning about the horizontal axis in the vertical plane. Also, when the ice rake of the present invention is displacing ice to remove the fragmentary ice from the storage bin, the ice rake translates longitudinally in the storage bin.

An ice storage and delivery system formed in accordance with the present invention has a number of advantages. An important advantage of the novel storage and delivery system is the ability of the ice rake to radially displace fragmentary ice.

Accordingly, an object of this invention is to provide an improved ice storage and delivery system that overcomes the aforementioned inadequacies of the prior art ice storage and delivery systems.

Another object of the present invention is to provide an ice storage and delivery system to facilitate ice displacement in an ice storage bin.

Still another object of the present invention is to provide a structurally simple and economical device for raking fragmentary ice in an ice storage bin.

Yet another object of the present invention is to provide an ice rake in an ice storage bin which prevents blue ice from forming by radially displace the fragmentary ice.

Still yet another object of the present invention is to provide an ice rake in a storage bin which leaves a smaller foot print in the ice when displacing the ice from the storage bin.

The foregoing has broadly outlined some of the more pertinent objects and features of the present invention. These should be construed to be merely illustrative of some of the more prominent features and applications of the intended invention. Many other beneficial results can be obtained by applying the disclosed invention in a different manner or by modifying the disclosed embodiments. Accordingly, other objects and a more comprehensive understanding of the invention may be obtained by referring to the detailed description of the preferred embodiment taken in conjunction with the accompanying drawings, in addition to the scope of the invention defined by the claims. For a more succinct understanding of the nature and objects of the present invention, reference should be directed to the following detailed description taken in connection with the accompanying drawings.

DETAILED DESCRIPTION OF THE PREFERRED EMBODIMENT

Figure 1:
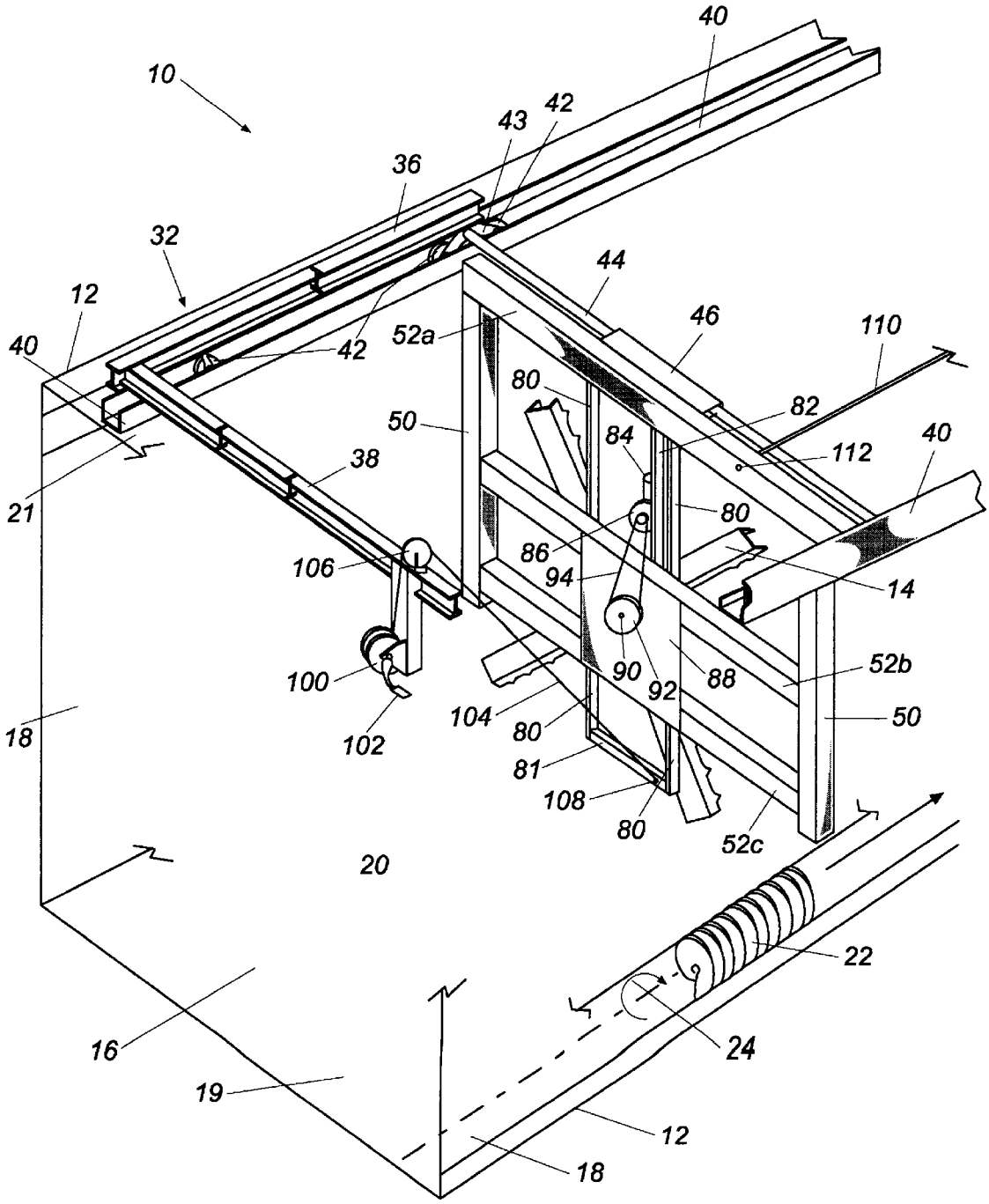
FIG. 1 is a front perspective view of one embodiment of an ice storage and delivery system according to the present invention.

Referring now to the drawings in which like numerals indicate like elements throughout the several views, FIG. 1 depicts an ice storage and delivery system 10 comprising an enclosure referred to as a storage bin generally designated as 12, and an ice rake generally designated as 14 for displacing the fragmentary ice 15 stored in the storage bin 12. The storage bin 12 has a floor 16, front and back side walls 18, left end wall 19, and a right end wall (not shown) to define a space 20 for receiving and storing the fragmentary ice 15. The fragmentary ice 15 is deposited into the storage bin 12 through an opening (not shown) in the top 21 of the storage bin 12.

Preferably, the ice storage and delivery system 10 is made of corrosion and rust resistant materials. While any convenient material may be used for the storage bin 12 and the ice rake 14, galvanized steel and stainless steel has been used satisfactorily to provide the necessary corrosion and rust resistance. Due to the reduced number of parts needed to assemble the ice rake 14 of the present invention, compared to known ice rakes, stainless steel is the preferred material for manufacturing the ice rake 14. The ice rake 14 is described in greater detail below. Preferably, the storage bin 12 is rectangular in shape due to the manner in which the ice rake 14 operates within the storage bin 12. However, the storage bin 12 of the present invention has the advantage that it may have an unlimited length as explained in greater detail below. Fragmentary ice 15 is deposited through an opening (not shown) in the top 21 of storage bin 12 in a manner known by those skilled in the art.

Figure 2:
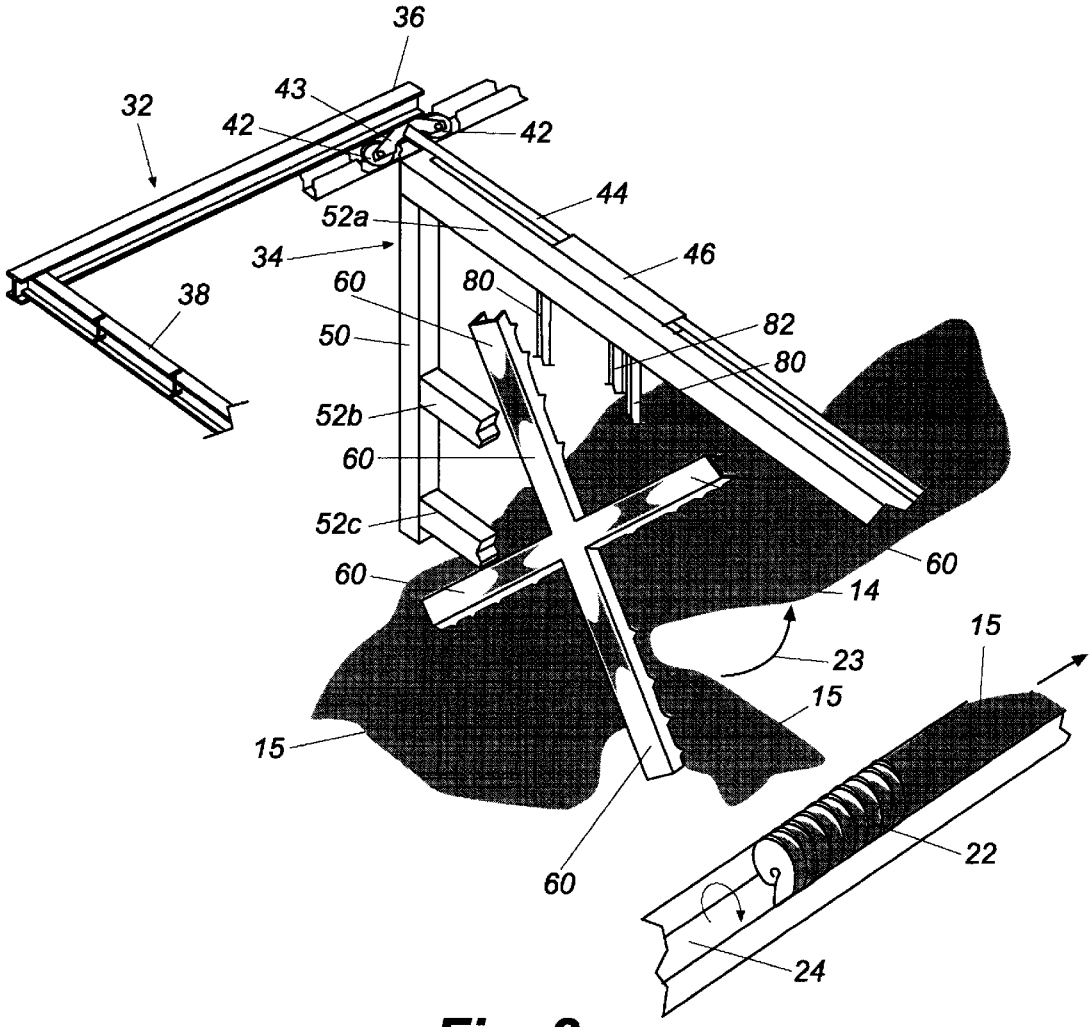
FIG. 2 is a partial front perspective view of the ice storage and delivery system in FIG. 1, illustrating an ice rake radially displacing a portion of the fragmentary ice pile.

The storage bin 12 of the present invention is particularly distinguishable from other storage bins known to those skilled in the art of commercial manufacture of fragmentary ice, in that a discharge screw conveyor 22 and trough 24 are positioned adjacent one side 18, in the floor 16, along the length of the storage bin 12. The discharge screw conveyor 22 and trough 24 are for receiving and discharging the fragmentary ice 15 from the storage bin 12 as shown in FIG. 2. Conversely, traditional ice storage bins have a screw conveyor in the short side or front of the storage bin. In the present invention, the conveyor 22 and trough 24 can extend the length of the storage bin 12. Thus, the storage bin 12 of the present invention may be of an unlimited length because its length is not limited by requiring the screw conveyor and trough to be positioned at the end of the storage bin 12 for the system to operate.

The ice storage and delivery system 10 of the present invention comprises a chassis which suspends the ice rake 14 in the storage bin 12 above the fragmentary ice 15. As best shown in FIG. 2, the chassis includes a carriage generally designated as 32 and a frame generally designated as 34. The overall chassis is preferably formed from a plurality of rigid elements suitably interconnected by generally known means, such as welding or bolting, to define a robust truss design. In FIG. 2, the ice rake 14, described in greater detail below, rotates in the direction indicated by directional arrow 23 to radially displace fragmentary ice 15 into the screw conveyor 22.

Figure 7:
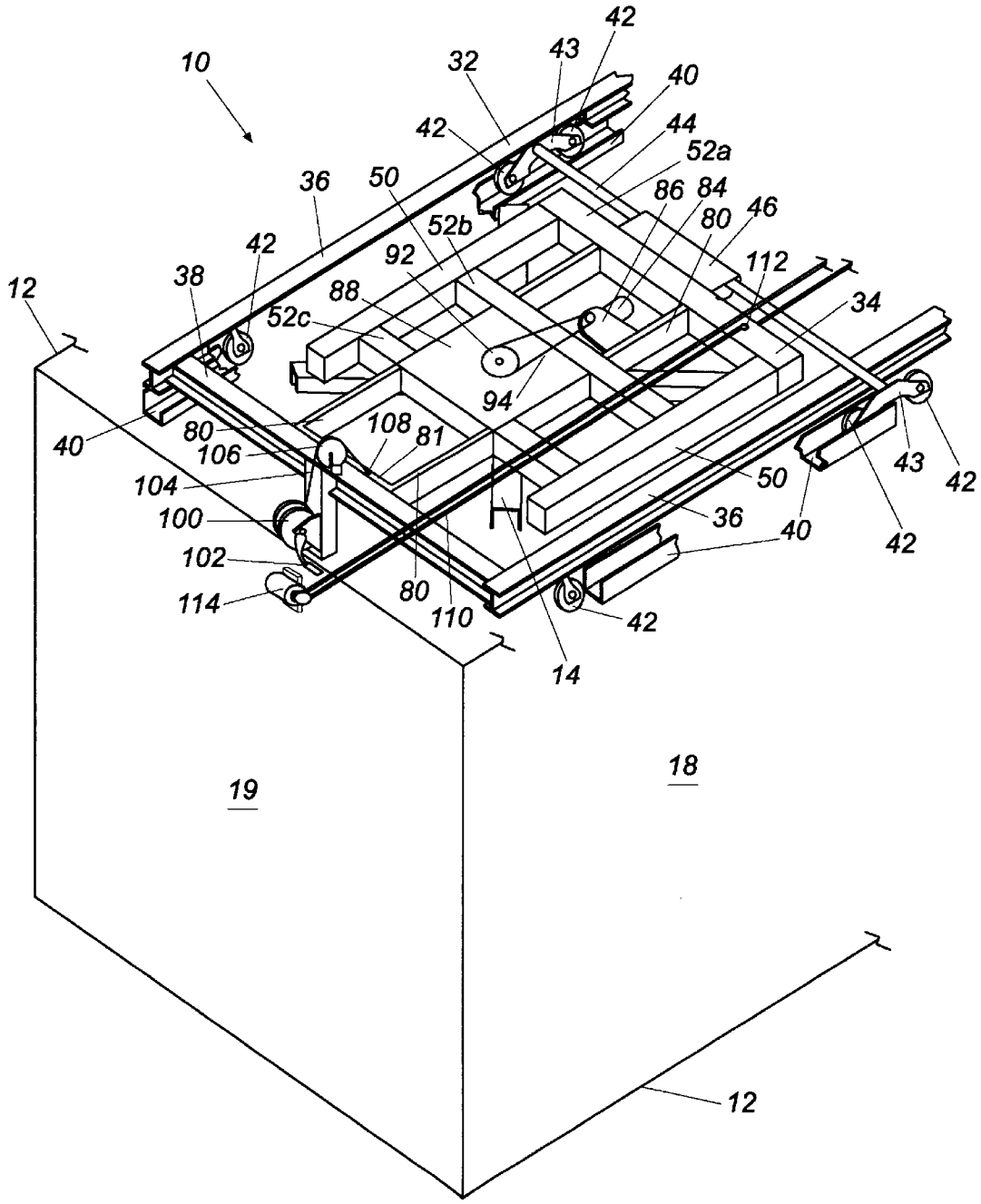
FIG. 7 is a front perspective view of the ice storage and delivery system in FIG. 1, illustrating the ice rake in a second position wherein the elongated members are positioned to rotate in a substantially horizontal plane about a substantially vertical axis.

In the preferred embodiment, the structure of the chassis is formed from simple beams and I-beams. As best shown in FIG. 7, the carriage 32 has a pair of laterally spaced I-beams 36 aligned with the longitudinal sides of the storage bin. Another I-beam 38 is suitably welded or otherwise secured to the one end of each of the I-beams 36 to provide a rigid, generally U-shaped carriage 32. The carriage 32 sits in a pair of laterally spaced, generally L-shaped channels 40 which extend longitudinally along the length of the storage bin and substantially parallel to the floor 16. The channels 40 are fixed to the front and back side walls 18 on the inside of the storage bin 12 and are elevated above the floor 16 to the extent that movement of the carriage 32 in the channels 40 and in the storage bin 12 is unimpeded by the pile of fragmentary ice 15 accumulating in the storage bin.

Figure 3:
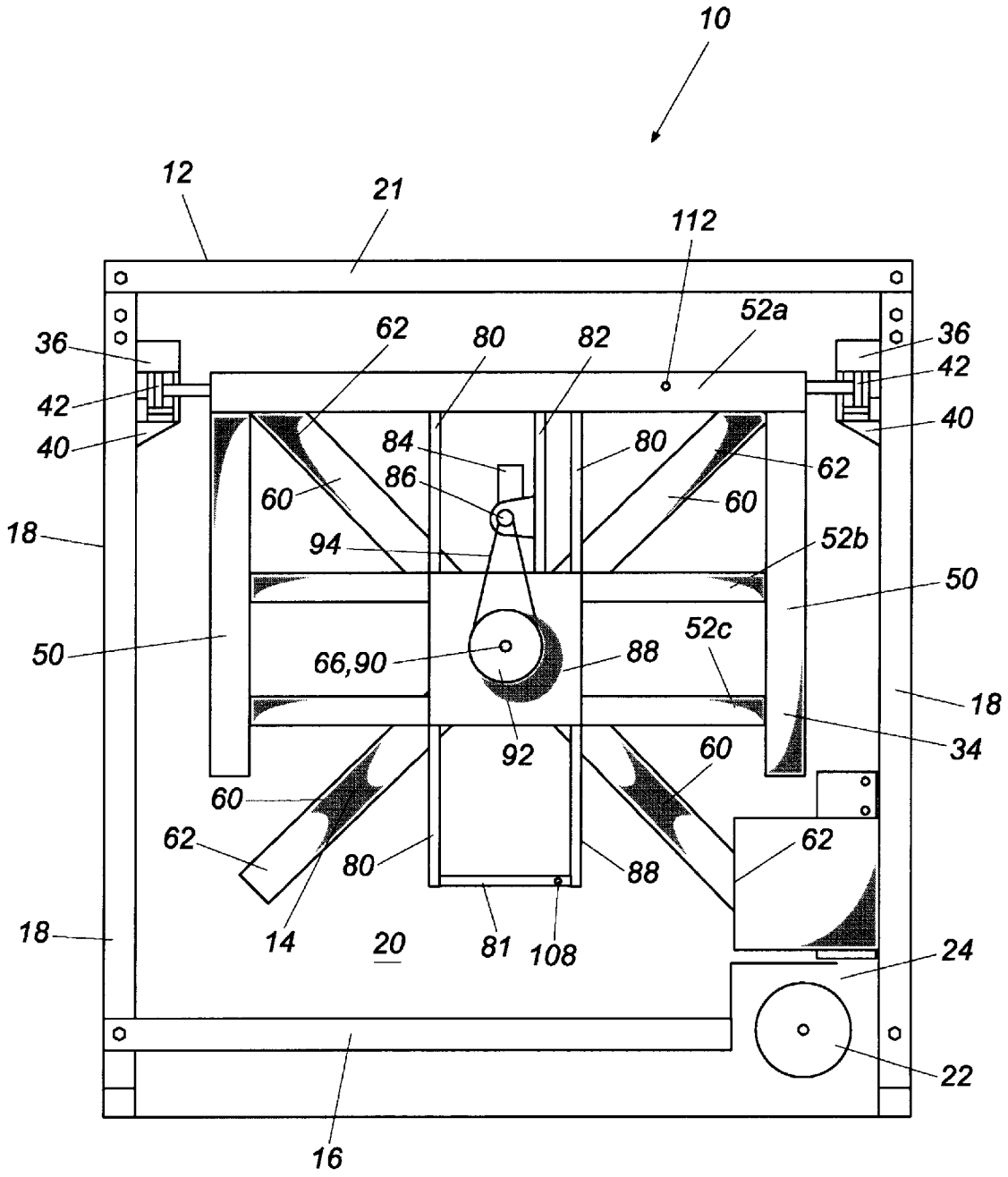
FIG. 3 is a left end view of the ice storage and delivery system in FIG. 1, illustrating an ice rake in a first position wherein a plurality of elongated members are positioned to rotate in a substantially vertical plane about a substantially horizontal axis.
Figure 4:
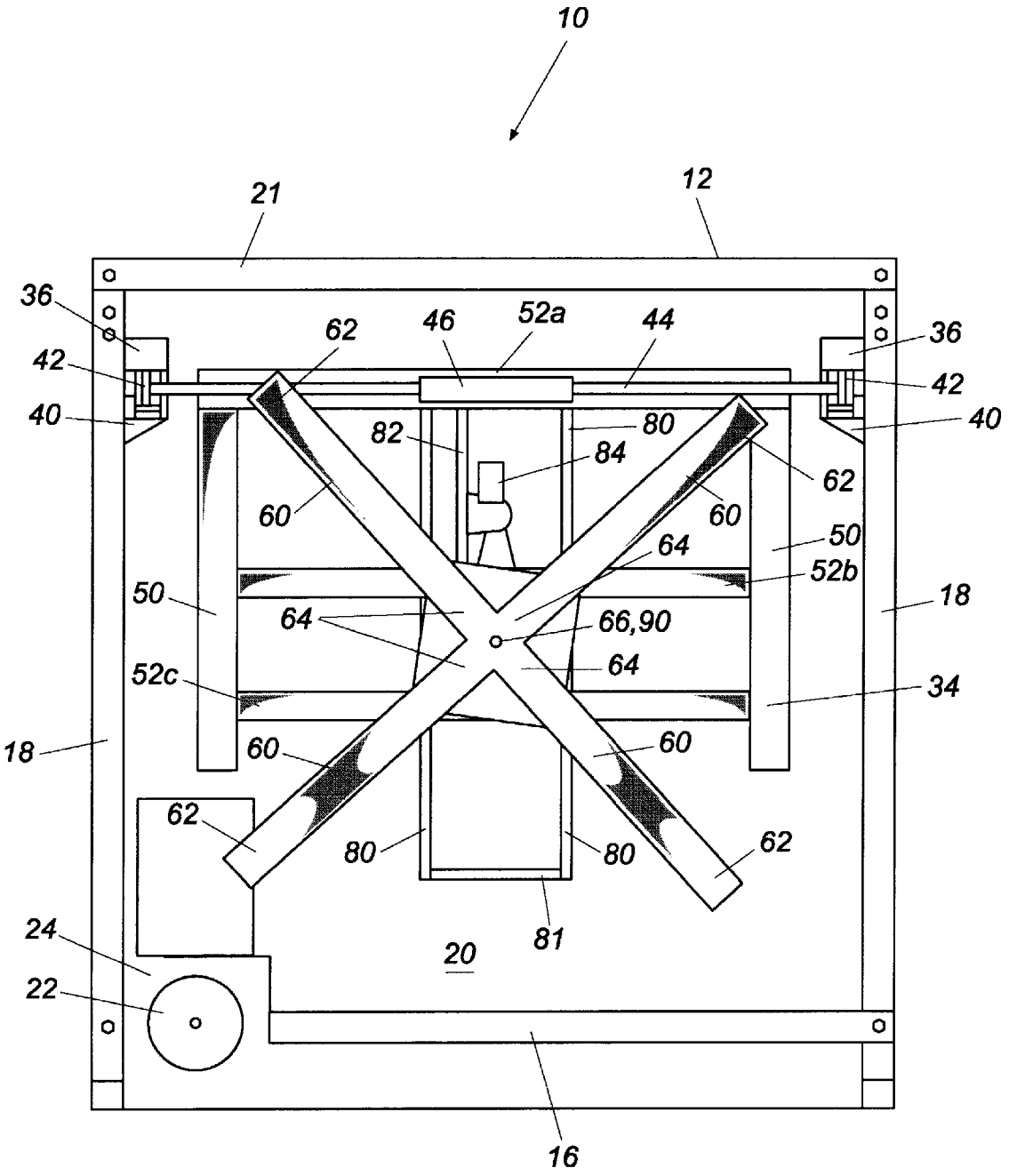
FIG. 4 is a right end view of the ice storage and delivery system in FIG. 1, also illustrating the ice rake in a first position wherein the elongated members are positioned to rotate in the vertical plane about the horizontal axis.

As best shown in FIG. 7, the carriage 32 includes three pairs of wheels 42 that are sized to rotate and run along the lengths of the channels 40. The wheels 42 rotate about an axle that is transverse to the channels 40 and parallel to the I-beam 38. The carriage 32 is supported above the channels 40 by a pair of pillow block bearings 43. The pair of wheels 42 furthest from the left end wall 19 has an axle 44 therebetween which spans substantially across the width of the ice storage bin 12. The frame 34 of the chassis is formed from a pair of laterally spaced beams 50 and three spaced apart cross member beams 52*a*–52*c*. The beams 50 and 52 are suitably welded or otherwise secured to one another to provide a rigid, generally figure 8-shaped frame 34 as best shown in FIGS. 1, 3 and 4. One of the outermost cross member beams 52*a* is pivotally connected to the axle 44 with a channel 46 drilled so that the axle 44 penetrates through the channel and attaches to the frame 34. The frame 34 is permitted to freely swing down into the storage bin 12 from the axle 44 and the carriage 32. The ice rake 14 on the frame 34 is pivotally suspended in the storage bin 12 by the carriage 32 and the axle 44.

Figure 5:
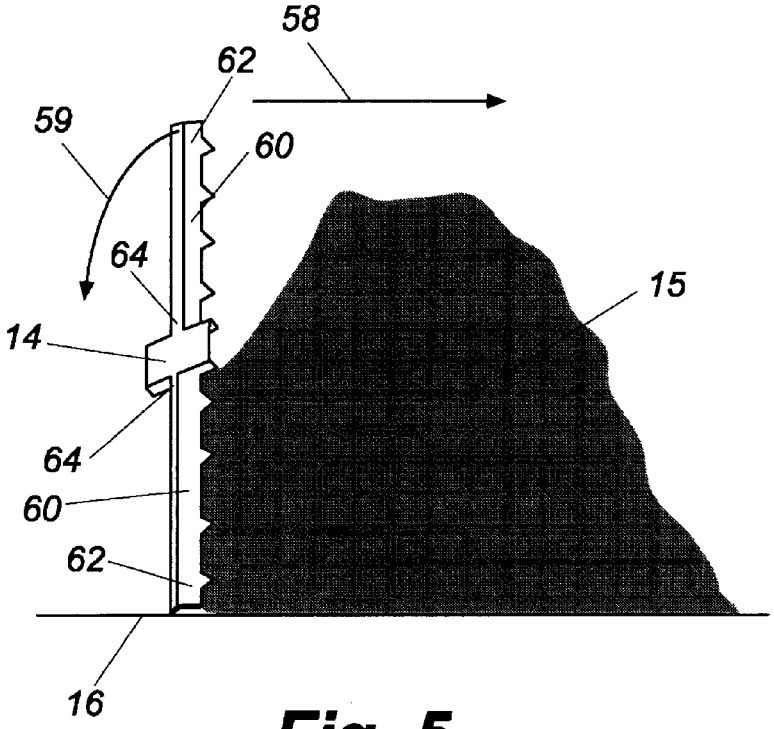
FIG. 5 is a front side view of one embodiment of the ice rake translating through the fragmentary ice pile.

The ice rake 14 of the present invention, when in the vertical plane as shown in FIG. 5, radially displaces the fragmentary ice 15 as it translates the length of the storage bin 12 from the left end wall 19 to the opposing right end wall (not shown). In FIG. 5, directional arrow 58 indicates the direction of translational movement of the ice rake 14 into the pile of fragmentary ice 15. Directional arrow 59 indicates the direction of rotation of the ice rake 14 about the horizontal axis.

The ice rake 14 of the preferred embodiment comprises a plurality of elongated members 60 having distal ends 62 and proximal ends 64. The elongated members 60 are configured for contacting and radially displacing the fragmentary ice 15 stored in the storage bin 12. The elongated members 60 are preferably equidistant apart from one another and extend radially from an axis 66.

Figure 6:
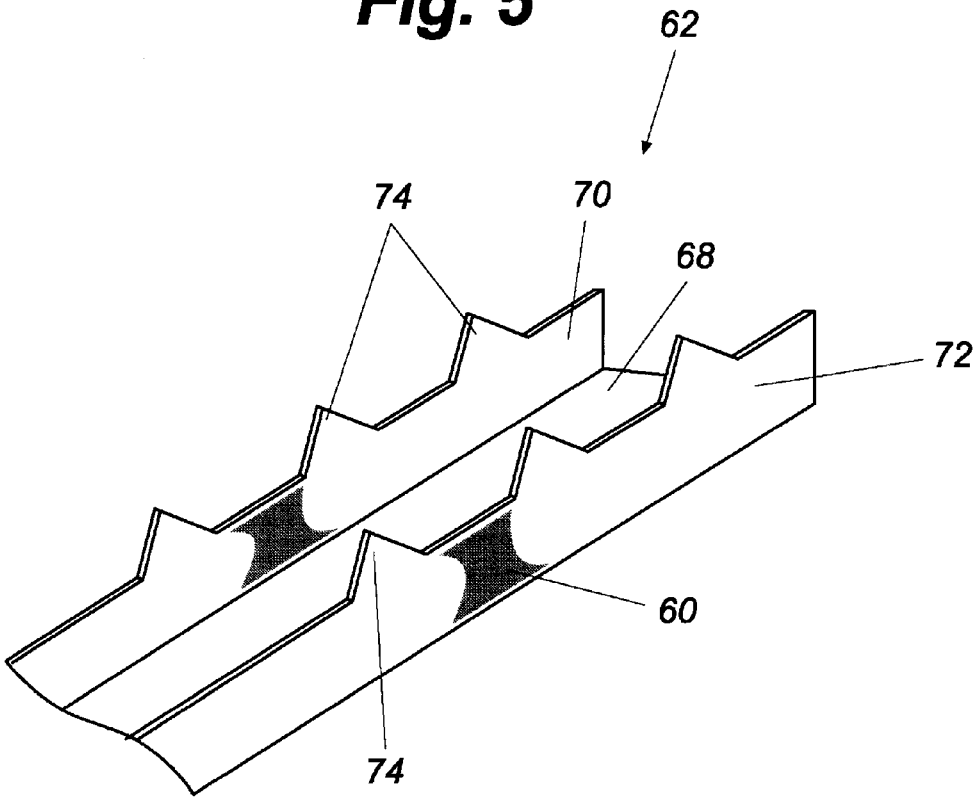
FIG. 6 is a perspective view of one embodiment of the distal end of an elongated member of the ice rake of the ice storage and delivery system in FIG. 1.

FIG. 6 illustrates the distal end 62 of one elongated member 60. The elongated members 60 are preferably channel members having a base 68 and a pair of spaced flange elements 70 and 72. Thus, the preferred embodiment of the elongated members 60 of the ice rake 14 has a generally U-shaped cross section. FIGS. 4 and 6 also illustrate the elongated member 60 having teeth 74 preferably integrally formed from the flange elements 70 and 72 and extending into the space 20 of the storage bin 12. Alternatively, the teeth 74 may simply be welded to the flanges 70, 72 or the base 68. The teeth 74 are preferably narrow triangular projections which extend along the length of each flange 70, 72 of each elongated member 60 in a staggered manner (not shown) or at intervals as shown in FIG. 6.

As best shown in FIGS. 3 and 4, the frame 34 includes a pair of spaced-apart outer support members 80 which are suitably secured to the cross members 52 between the beams 50. The support members 80 are substantially aligned parallel with the beams 50 and are preferably longer than the beams 50 such that the support members partially extend beyond the frame 34. An end support member 81 is secured between the ends of the support members 80 which extend beyond the frame 34. An intermediate support member 82 is aligned between the outer support members 80 and is secured to the frame 34 between the cross member 52*a* and the cross member 52*b*.

The ice rake 14 is preferably chain or belt driven by a motor 84 mounted to a flange member 86. The flange member 86 extends from the intermediate support member 82. A panel 88 is secured between the cross members 52*b* and 52*c* and an axle 90 passes through the panel 88. The axle 90 is coincident with axis 66. The elongated members 60 are secured to one end of the axle 90 on one side of the panel 88 and a pulley or sprocket 92 is secured to the other end of the axle 90 on the other side of the panel 88. The pulley/sprocket 92 is aligned with the motor 84 above, with a drive belt/chain 94 coupled therebetween, as best shown in FIGS. 3 and 4. The motor 84 drives the drive belt/chain 94 such that the pulley/sprocket 92 and axle 90 turn. Turning of the axle 90 turns the ice rake 14. As the ice rake 14 turns, the elongated members 60 come into contact with and displace the fragmentary ice 15.

It is preferable that the motor 84 rotate the elongated members 60 to make complete revolutions in a single direction. Alternatively, the motor 84 may oscillate such that the elongated members 60 never make a complete revolution. With an oscillating motor, the ice rake 14 continuously reverses direction. Ice will be displaced in a different direction each time the ice rake 14 reverses direction. In either manner of operation of the motor 84, the ice rake 14 is moved horizontally along the length of the storage bin 12, as shown in FIG. 5, as the elongated members 60 turn in order to repeat the displacement of ice operation in a new position on the pile of fragmentary ice 15. The sequential, horizontal movement of the ice rake 14 as it turns along the length of the fragmentary ice pile is often referred to as indexing.

Figure 8:
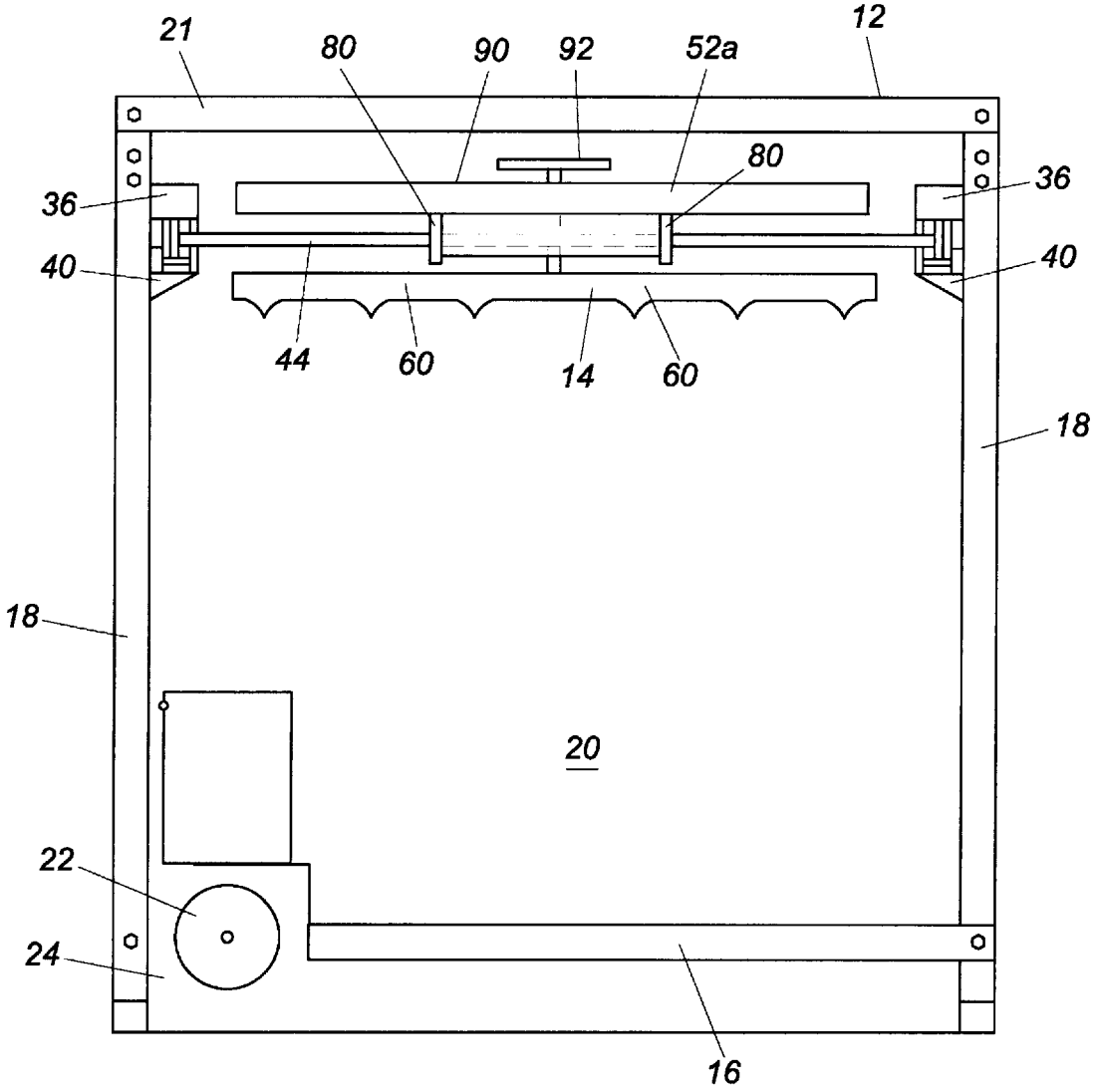
FIG. 8 is a right end view of the ice storage and delivery system in FIG. 1, also illustrating the ice rake in the second position wherein the elongated members are positioned to rotate in the horizontal plane about the vertical axis.

The ice rake 14 may be pivoted between first and second positions when employed in the storage bin 12. In the first position, as shown in FIGS. 1–5, the elongated members 60 of the ice rake 14 turn in a substantially vertical plane about a substantially horizontal axis. When in the first position, the ice rake 14 radially displaces the fragmentary ice 15 in the storage bin in the vertical plane relative to the horizontal axis. As shown in FIGS. 7 and 8, the ice rake turns in a substantially horizontal plane about a substantially vertical axis when in the second position. When in the second position, the ice rake radially displaces the fragmentary ice 15 in the storage bin in the horizontal plane relative to the vertical axis. Also, fragmentary ice 15 may be deposited through the top of the storage bin 12 while the ice rake 14 is operating in either position. The ice rake 14 preferably turns in the range of approximately 5 to 20 rpm. Most preferably, the ice rake 14 turns at approximately 10 rpm. Thus, the ice rake 14 turns at a rate which is slow enough to permit the fragmentary ice 15 to be deposited in the storage bin even while the ice rake is operating in the second position.

In order for the ice rake 14 to pivot up into the second position, a winch 100 is secured to the carriage 32 as shown in FIGS. 1 and 7. The winch includes a hand crank 102 and cable 104. The cable 104 passes over a pulley 106 mounted on top of the I-beam 38. The end of the cable 104 is attached to the end support member 81 at a point referred to as 108 in FIGS. 1 and 3. When the cable 104 is reeled in by the winch 100, the winch 100 pulls the frame 34 into the second position and into alignment with the carriage 32 as shown in FIGS. 7 and 8. The winch 100 lets the ice rake fall back into the first position by unreeling the cable 104 from the winch 100 such that the frame 34 pivots away from carriage 32.

When the ice rake 14 is turning in the second position, the elongated members 60 are turning in the horizontal plane such that they level-out the pile of fragmentary ice 15 relative to the floor 16 as the distal end 62 of each elongated member 60 contacts the ice. The ice rake 14 may translate longitudinally within the storage bin 12. The fragmentary ice 15 thus becomes evenly distributed throughout the storage bin 12. This allows the ice rake 14 to displace the fragmentary ice 15 into the discharge screw conveyor 22 and trough 24, when the ice rake 14 is in the first position.

When in the first position, the carriage 32 allows the frame 34 with the ice rake 14 to translate longitudinally within the storage bin 12. It is also possible for the ice rake 14 to translate in the storage bin 12 when in the second position. However, the pile of fragmentary ice 15 may be sufficiently leveled-out when the ice rake is operating and is positioned in a stationary manner directly above the pile of fragmentary ice 15. Therefore, translation of the ice rake 14 while in the second position is typically not necessary.

In order for the carriage to roll on the wheels 42 in the channels 40, thereby providing translational movement of the ice rake 14 relative to the floor 16 of the storage bin 12, one end of a cable or belt 110 is attached to the cross member 52*a* at a point referred to as 112 in FIGS. 1 and 3. The other end of the cable/belt 110 is also attached to the cross member 52*a* at a point (not shown) immediately opposite point 112. The cable/belt 110 is suspended between a pulley (not shown) on the right end wall (not shown) and a motor 114 mounted on the left end wall 19. The motor 114 is shown in FIG. 7. The cable/belt 110 is coupled to the pulley and motor 114 to define a loop. However, the loop is interrupted by the connections of the cable/belt 110 to the cross member 52*a* as described above. The direction in which the motor 114 drives the cable/belt 110 determines the direction in which the chassis translates in the storage bin 12.

The ice rake 14 of the present invention radially displaces the fragmentary 15 relative to the direction in which the elongated members 60 are turning. Thus, the ice rake 14 in the first position radially displaces the fragmentary ice 15 into the discharge screw conveyor 22 and trough 24 as the ice rake 14 rotates about the horizontal axis and longitudinally translates or indexes along the length of the storage bin 12. As best shown in FIGS. 3 and 4, the axis 66 in which the ice rake 14 turns is offset from the screw conveyor 22 and trough 24. As the ice rake 14 translates, the teeth 74 dislodge fragmentary ice 15 from the ice pile in the storage bin 12. The dislodged fragmentary ice 15 is displaced substantially perpendicular to the direction of the translational movement of the ice rake 14 in the storage bin 12 in order to be received by the screw conveyor 22 and trough 24.

The use of the ice storage and delivery system 10 as described above constitutes an inventive method of the present invention in addition to the ice storage and delivery system 10 itself. In practicing the method of evacuating fragmentary ice 15 as described above, the steps include providing a storage bin 12 containing fragmentary ice 15. The method then includes the step of providing an ice rake 14, as described above, employed in the storage bin 12. The method also includes the step of radially displacing the fragmentary ice 15 by turning the ice rake 14 about an axis and contacting the fragmentary ice 15 in the storage bin 12 with the ice rake 14 such that portions of the pile of fragmentary ice 15 are moved radially relative to the axis.

The method of the present invention may further comprise the step of pivoting the ice rake 14 from a first position to a second position and vice versa, wherein the ice rake 14 is in the first position when rotating about a horizontal axis and in the second position when rotating about a vertical axis. Also, the method may further comprise the step of translating the ice rake 14 longitudinally in the storage bin 12 substantially parallel to the floor 16. The storage bin 12 may be filled while the ice rake 14 is operating or not.

The step of radially displacing the fragmentary ice 15 may comprise passing the ice rake 14 through the height of the pile of fragmentary ice 15 upon each occurrence of the ice rake contacting the pile of fragmentary ice 15. Also, where the axis about which the ice rake 14 turns is a vertical axis, the step of radially displacing the fragmentary ice 15 comprises the ice rake 14 turning about the vertical axis in a substantially horizontal plane such that the fragmentary ice 15 in the horizontal plane is moved relative to the vertical axis.

The present invention has been illustrated in great detail by the above specific examples. It is to be understood that these examples are illustrative embodiments and that this invention is not to be limited by any of the examples or details in the description. Those skilled in the art will recognize that the present invention is capable of many modifications and variations without departing from the scope of the invention. Accordingly, the detailed description and examples are meant to be illustrative and are not meant to limit in any manner the scope of the invention as set forth in the following claims. Rather, the claims appended hereto are to be construed broadly within the scope and spirit of the invention.

What is claimed is:

1. A self-evacuating ice storage bin for storage and delivery of fragmentary ice, comprising:

an enclosure for containing a pile of said fragmentary ice; and a device for providing displacement of said pile of fragmentary ice, said device employed in said enclosure and including an ice-contacting member mounted to said device for rotational and translational movement relative to said pile of ice such that said ice-contacting member turns about a substantially horizontal axis in a substantially vertical plane and also translates along a path having a horizontal component, such that said ice-contacting member radially displaces said fragmentary ice pile in said vertical plane relative to said horizontal axis while progressing along said path.

2. The self-evacuating ice storage bin of claim 1, wherein said device is selectably operative to turn about a substantially vertical axis in a substantially horizontal plane such that said device radially displaces said fragmentary ice pile in said horizontal plane relative to said vertical axis; and wherein said path is substantially perpendicular to said vertical axis.

3. The self-evacuating ice storage bin of claim 1, further comprising means to pivotably suspend said device in said enclosure.

4. An ice rake storage and delivery system for storage and displacement of fragmentary ice, comprising:

an enclosure defining a space for receiving and storing a pile of fragmentary ice; and a device for radially displacing said pile of fragmentary ice, said device employed in said enclosure and including an ice-contacting member mounted to said device for rotational and translational movement, such that said ice-contacting member turns about an axis, and also translates along a path having a horizontal component such that said ice-contacting member radially displaces the pile of fragmentary ice relative to said axis while progressing along said path.

5. The ice rake storage and delivery system of claim 4, wherein said device comprises a plurality of elongated members having distal and proximal ends, said elongated members turning about said axis, said distal ends configured for contacting and radially displacing the pile of fragmentary ice.

6. The ice rake storage and delivery system of claim 5, wherein said elongated members are equidistant apart and extend radially from said axis into said space.

7. The ice rake storage and delivery system of claim 5, wherein each said elongated member comprises a plurality of teeth, said teeth extending from each said elongated member into said space.

8. The ice rake storage and delivery system of claim 4, further comprising means for rotational movement of said device about said axis, said rotational means coupled to said device at said axis, thereby performing said radial displacement in response to said rotational movement.

9. The ice rake storage and delivery system of claim 4, further comprising an apparatus for receiving and for discharging from said enclosure said pile of fragmentary ice displaced by said device when said device is turning about said axis, said axis and said apparatus being offset from one another.

10. The ice rake storage and delivery system of claim 9, wherein said apparatus comprises a trough and a screw conveyor in said trough.

11. An ice rake storage and delivery system for storage and displacement of fragmentary ice, comprising:

an enclosure defining a space for receiving and storing the fragmentary ice;

a means for radially displacing the fragmentary ice, said displacement means employed in said enclosure and turning about an axis, said displacement means radially displacing the fragmentary ice relative to said axis; and pivoting means coupled to said displacement means for pivoting said displacement means between a first position and a second position, said displacement means turning in a substantially vertical plane about a substantially horizontal axis when in said first position and turning in a substantially horizontal plane about a substantially vertical axis when in said second position.

12. The ice rake mechanism of claim 11, wherein said enclosure includes a floor and said displacement means levels-out the fragmentary ice stored in said enclosure relative to said floor when said displacement means is in said second position and is turning about said vertical axis to radially displace the fragmentary ice.

13. An ice rake storage and delivery system for storage and displacement of fragmentary ice, comprising:

an enclosure defining a space for receiving and storing the fragmentary ice;

a means for radially displacing the fragmentary ice, said displacement means employed in said enclosure and turning about an axis, said displacement means radially displacing the fragmentary ice relative to said axis; and means for translational movement of said displacement means, said enclosure having a floor and said displacement means translating longitudinally in said enclosure and substantially parallel to said floor.

14. A method of displacing a pile of fragmentary ices comprising the steps of:

providing an enclosure for receiving said pile of fragmentary ice;

providing a device employed in said enclosure;

providing an ice-contacting member mounted to said device for rotational and translational movement;

turning said ice-contacting member about an axis; and translating said ice-contacting member along a path having a horizontal component, such that said ice-contacting member radially displaces said pile of fragmentary ice relative to said axis while progressing along said path.

15. The method of claim 14, wherein said step of radially displacing said pile of fragmentary ice comprises passing the device through the height of said pile of fragmentary ice upon each occurrence of said device contacting said pile of fragmentary ice.

16. The method of claim 14, wherein said device comprises a plurality of elongated members extending radially from said axis, and wherein said step of radially displacing said pile of fragmentary ice comprises each said elongated member passing through the pile of fragmentary ice as said elongated members turn about said axis, each said elongated member thereby moving a portion of the pile of fragmentary ice as it passes through said pile of fragmentary ice.

17. The method of claim 14, wherein said axis is substantially a vertical axis and wherein said step of radially displacing said pile of fragmentary ice comprises said device turning about said vertical axis in a substantially horizontal plane such that said pile of fragmentary ice in said horizontal plane is moved relative to said vertical axis.

18. A method of displacing a pile of fragmentary ice, comprising the steps of:

providing an enclosure for receiving the fragmentary ice;

providing a displacement means employed in said enclosure;

radially displacing the fragmentary ice by turning said displacement means about an axis and contacting the fragmentary ice in said enclosure with said displacement means such that portions of said pile of fragmentary ice are moved radially relative to said axis; and pivoting said displacement means from a first position to a second position and vice versa, said displacement means being in said first position when said axis is a horizontal axis and said displacement means is turning about said horizontal axis, and said displacement means being in said second position when said axis is a vertical axis and said displacement means is turning about said vertical axis, whereby said displacement means in said second position levels-out the fragmentary ice in said enclosure.

19. A method of displacing a pile of fragmentary ice, comprising the steps of:

providing an enclosure for receiving the fragmentary ice;

providing a displacement means employed in said enclosure;

radially displacing the fragmentary ice by turning said displacement means about an axis and contacting the fragmentary ice in said enclosure with said displacement means such that portions of said pile of fragmentary ice are moved radially relative to said axis; and translating said displacement means longitudinally in said enclosure and substantially parallel to a floor of said enclosure, said displacement means displacing fragmentary ice substantially laterally relative to the direction of said translational movement.

20. An ice rake for displacing a pile of fragmentary ice, comprising:

an enclosure defining a space for receiving and storing the pile of fragmentary ice; and means for displacing the pile of fragmentary ice, said device employed in said enclosure and indexing horizontally through the length of said enclosure.

21. A self-evacuating ice storage bin for storage and delivery of fragmentary ice, comprising:

an enclosure;

means for providing displacement of the fragmentary ice, said displacement means employed in said enclosure and turning about a substantially horizontal axis in a substantially vertical plane such that said displacement means radially displaces the fragmentary ice in said vertical plane relative to said horizontal axis; and said displacement means being selectably pivotable between a first position and a second position, said displacement means in said first position contacting the fragmentary ice in said vertical plane to radially displace the fragmentary ice relative to said horizontal axis when turning about said horizontal axis, and said displacement means in said second position contacting the fragmentary ice in a substantially horizontal plane and turning about a substantially vertical axis to radially displace the pile of fragmentary ice relative to said vertical axis.

22. The self-evacuating ice storage bin of claim 21 wherein said displacement means levels-out the fragmentary ice in said enclosure and in said horizontal plane when turning about said vertical axis and radially displacing the fragmentary ice relative to said vertical axis.

23. A self-evacuating ice storage bin for storage and delivery of fragmentary ice, comprising:

an enclosure;

means for providing displacement of the fragmentary ice, said displacement means employed in said enclosure and turning about a substantially horizontal axis in a substantially vertical plane such that said displacement means radially displaces the fragmentary ice in said vertical plane relative to said horizontal axis; and said displacement means being longitudinally translatable within said enclosure.

24. The self-evacuating ice storage bin of claim 23 wherein said displacement means displaces fragmentary ice substantially perpendicular to the direction of said translational movement of said displacement means in said enclosure.

25. An apparatus for storage and delivery of fragmented ice, said apparatus comprising:

an ice-supporting floor portion configured to support a pile of ice;

an ice-receiving cavity located laterally adjacent to said ice-supporting floor portion; and an ice-contacting member configured for rotation about an axis such when said ice-contacting member rotates so that said ice-contacting member is positioned substantially perpendicular to a plane formed by said floor portion, said ice-contacting member causes ice on top of said pile to be ejected in a direction substantially parallel to a plane formed by said floor portion towards and into said ice-receiving cavity.

26. The apparatus for storage and delivery of fragmented ice of claim 25, wherein said cavity is elongate.

27. The apparatus for storage and delivery of fragmented ice of claim 26, further comprising an auger disposed within said elongate cavity for moving ice within said elongate cavity.

* * * * *